US006435650B1

(12) United States Patent
Nishioka et al.

(10) Patent No.: US 6,435,650 B1
(45) **Date of Patent: *Aug. 20, 2002**

(54) INK JET RECORDING APPARATUS AND METHOD

(75) Inventors: Atsushi Nishioka; Naoki Kobayashi, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/933,137

(22) Filed: Aug. 21, 2001

Related U.S. Application Data

(63) Continuation-in-part of application No. 09/876,175, filed on Jun. 8, 2001, which is a continuation of application No. 09/354,119, filed on Jul. 15, 1999, now Pat. No. 6,264,304.

(30) Foreign Application Priority Data

Jul. 15, 1998 (JP) ..... 10-201010

(51) Int. Cl.[7] ..... B41J 23/00
(52) U.S. Cl. ..... 347/37; 400/283
(58) Field of Search ..... 347/14, 23, 29, 347/32, 37, 39; 400/283

(56) References Cited

U.S. PATENT DOCUMENTS

| | | | | |
|---|---|---|---|---|
| 4,177,471 A | | 12/1979 | Mitchell | 347/37 |
| 4,551,735 A | | 11/1985 | Suzuki et al. | 347/32 |
| 4,695,851 A | | 9/1987 | Terasawa | 347/30 |
| 4,739,847 A | | 4/1988 | Terasawa | 347/19 |
| 4,967,204 A | | 10/1990 | Terasawa et al. | 347/23 |
| 5,359,358 A | | 10/1994 | Shimamura et al. | 347/9 |
| 5,426,456 A | | 6/1995 | Kuelzer et al. | 347/30 |
| 5,781,207 A | | 7/1998 | Hasegawa et al. | 347/23 |
| 6,189,997 B1 | | 2/2001 | Kanome et al. | 347/23 |
| 6,264,304 B1 | * | 7/2001 | Iwaya et al. | 347/37 |

FOREIGN PATENT DOCUMENTS

| | | |
|---|---|---|
| JP | 59-222360 | 12/1984 |
| JP | 60-178063 | 9/1985 |
| JP | 63-009548 | 1/1988 |
| JP | 63-011347 | 1/1988 |
| JP | 08-267774 | 10/1996 |

* cited by examiner

*Primary Examiner*—John Barlow
*Assistant Examiner*—Blaise L Mouttet
(74) *Attorney, Agent, or Firm*—Nixon & Vanderhye P.C.

(57) ABSTRACT

An ink jet recording apparatus with a carriage lock mechanism is provided with a timer for counting a waiting time at a home position when detecting the return of a carriage to the home position HP. When this waiting time has reached or exceeded a reference time, a carriage lock mechanism is driven to lock the carriage. A time (reference time) taken while the carriage is returned to the home position and is then locked can be set and/or changed to be an optimum time according to the configuration of use of the recording apparatus through a reference time setting part.

15 Claims, 7 Drawing Sheets

INK JET RECORDING APPARATUS AND METHOD

CROSS-REFERENCES TO RELATED APPLICATIONS

This is a continuation-in-part of U.S. patent application Ser. No. 09/876,175, filed Jun. 8, 2001; which is a continuation of U.S. patent application Ser. No. 09/354,119, filed Jul. 15, 1999 now U.S. Pat. No. 6,264,304, the entire contents of which are hereby incorporated by reference in this application.

STATEMENT REGARDING FEDERALLY SPONSORED RESEARCH OR DEVELOPMENT (NOT APPLICABLE)

BACKGROUND OF THE INVENTION

This invention is related to an ink jet recording apparatus and method, and more particularly to an ink jet recording apparatus with a carriage lock mechanism and a method for controlling the same.

RELATED ART

Typically an ink jet recording apparatus has a recording head which moves along a sheet of recording paper by means of a carriage, ejecting ink drops thus printing on the surface of the recording paper. Often times during printing, the carriage will be put into a waiting condition and be placed in a home position away from the printing area. While the carriage carrying the recording head is under a printing waiting condition, it moves to a predetermined home position, which is located off the recording area, and waits for a printing command at the home position.

Although the carriage driving mechanism applies a brake force to keep the carriage in its home position, exterior vibrations may move the carriage toward the recording area while the carriage is waiting in the home position. Furthermore, when electric power is turned off, the carriage may be able to freely move, and there is a risk that the carriage may move toward the recording area from the home position.

In order to prevent unwanted movement of the carriage, an ink jet recording apparatus is often provided with carriage lock mechanisms for mechanically fixing the carriage at the relevant home position. (For example, U.S. Pat. No. 4,695,851 and U.S. Pat. No. 4,739,847).

These conventional carriage locking mechanisms are constructed in such a way that each time the carriage returns to the home position the carriage is locked. Since the driving frequency of the carriage lock mechanism is high, there are associated problems with keeping the carriage locked. One such problem is that the components of the carriage lock mechanism rapidly deteriorate.

Another problem exists when printing should be restarted immediately after a previous printing is finished, requiring the carriage lock to be disengaged. The result is decreased responsiveness of the carriage when restarting printing.

It is desirable to have an ink jet recording apparatus which can prevent deterioration of the components caused by the carriage lock and decreased responsiveness when printing restarts, by avoiding unnecessary carriage lock actions.

BRIEF SUMMARY OF THE INVENTION

In general, in one aspect, the invention features an ink jet recording apparatus which includes a recording head for ejecting ink liquid drops, a carriage for carrying the recording head and adapted to translate between a recording area and a home position, a carriage lock mechanism for locking the carriage at the home position, a carriage controller for translating the carriage to the home position, a timer for measuring a waiting time during which the carriage translated by the carriage drive control part is at the home position, a lock controller which allows the carriage lock mechanism and the carriage to be in a locked condition when the waiting time measured by the timer has reached or exceeded a reference time, and setting structure for setting or changing the reference time.

The carriage lock will not be effected even if the carriage has returned to the home position, unless the carriage is waiting at the home position for more time than a predetermined period. If a command for restarting printing is issued during the reference time, the carriage can be immediately moved to the recording area. If the carriage lock is set simultaneously when the carriage has returned to the home position, the driving frequency of the carriage lock mechanism is reduced, and the deterioration of the components of the carriage lock mechanism can be reduced. In addition, since frequency of disengaging the carriage lock mechanism is low, the responsiveness at the restart of printing will be improved.

The setting structure for setting or changing the reference time may change some values prepared in advance through a switch such as a dip switch. Moreover, it is also possible to prepare a memory for storing the reference time and a command interpreter for receiving and analyzing a command transmitted from a host device and to constitute the setting structure by the following firmware. More specifically, if the command analyzed by the command interpreter is the set command for setting or changing the value of the reference time, it is preferable that the value of the reference time should be stored in the memory or the value stored in the memory should be changed based on the set command.

If a time required for a period in which the carriage is returned to the home position and carriage locking is then carried out is too short, the number of the carriage locking operations is not decreased so that effects are not increased. To the contrary, if the waiting time is too long, a time required for a period in which the carriage is not locked is prolonged. Consequently, there is a higher possibility that the ink might leak due to oscillations or impacts. According to the invention, however, the provider or user of the recording apparatus can set and/or change, to an optimum time, the time required for the period in which the carriage is returned to the home position, and carriage locking is then carried out according to the configuration of use of the recording apparatus (for example, the frequency of printing).

Implementations may include a maintenance unit for restoring the relevant recording head by sucking ink from ink nozzles in the recording head and disposing it to the exterior, and head restoration requesting structure for issuing a head restoration request by the maintenance unit. It is preferable that the carriage lock is instantly engaged when the head restoration request is issued, regardless of the time during which the carriage is waiting at the home position, to prevent the ink from leaking out by movement of the carriage during suction of the ink.

Since the printing action will not start immediately after the electric source of the apparatus is switched on, the carriage can be locked by actuating the carriage lock mechanism, regardless of the above-described waiting time.

Implementations may also include a detector for detecting that the carriage has moved to the home position so as to start a measurement of the waiting time by means of the timer, by referring to results of detection by the detector as a trigger.

The method for controlling the ink jet recording device according to the present invention is also specified by the same technical matters as described above, and attains the same operational effects The details of one or more embodiments are set forth in the accompanying drawings and the description below. Other features, objects, and advantages of the invention will be apparent from the description and drawings, and from the claims.

DETAILED DESCRIPTION OF PREFERRED EMBODIMENTS

Figure 1:
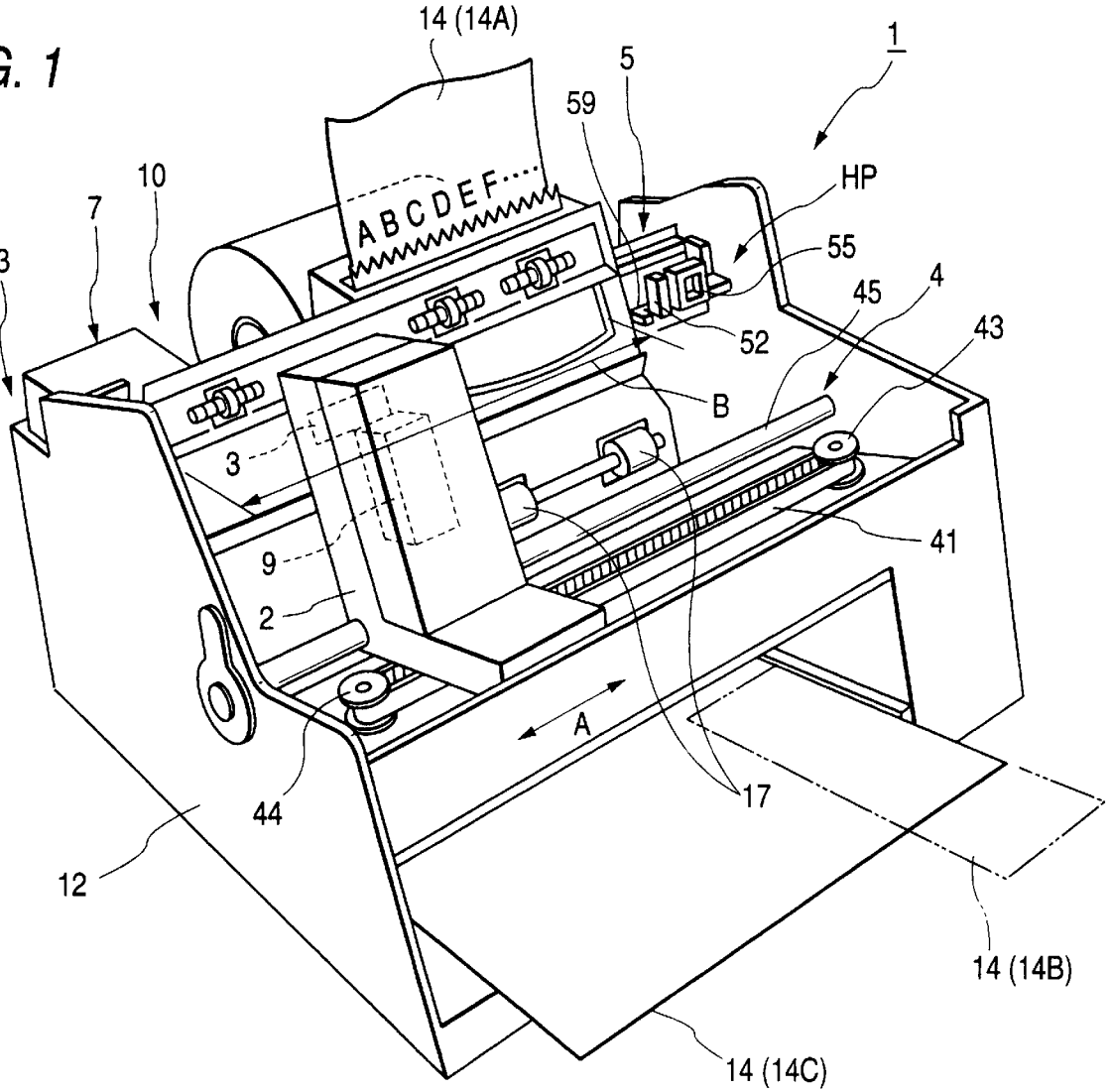
FIG. 1 is a perspective view of an implementation an ink jet recording apparatus.
Figure 2:
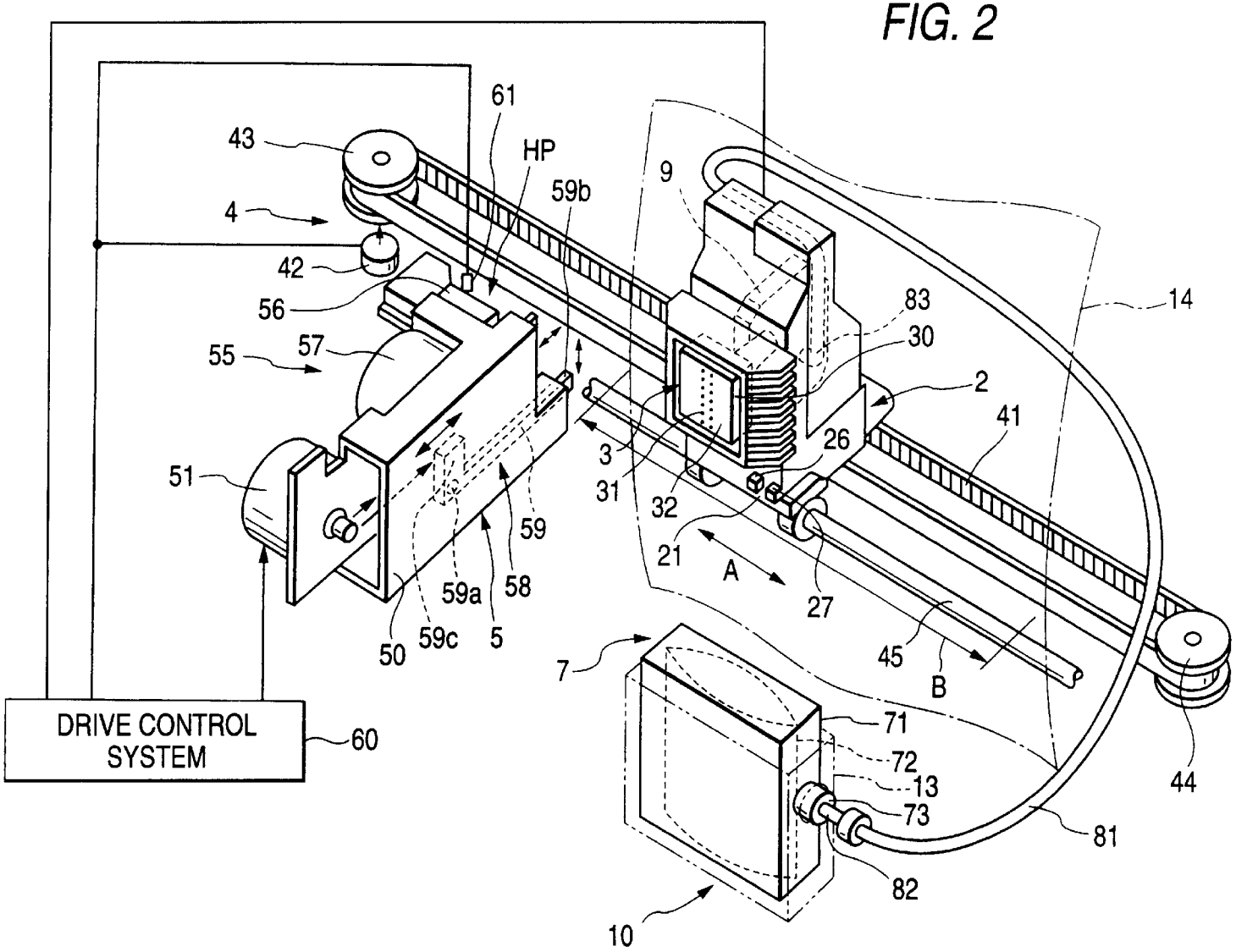
FIG. 2 is a perspective view showing a part of the apparatus as shown in FIG. 1.
Figure 3:
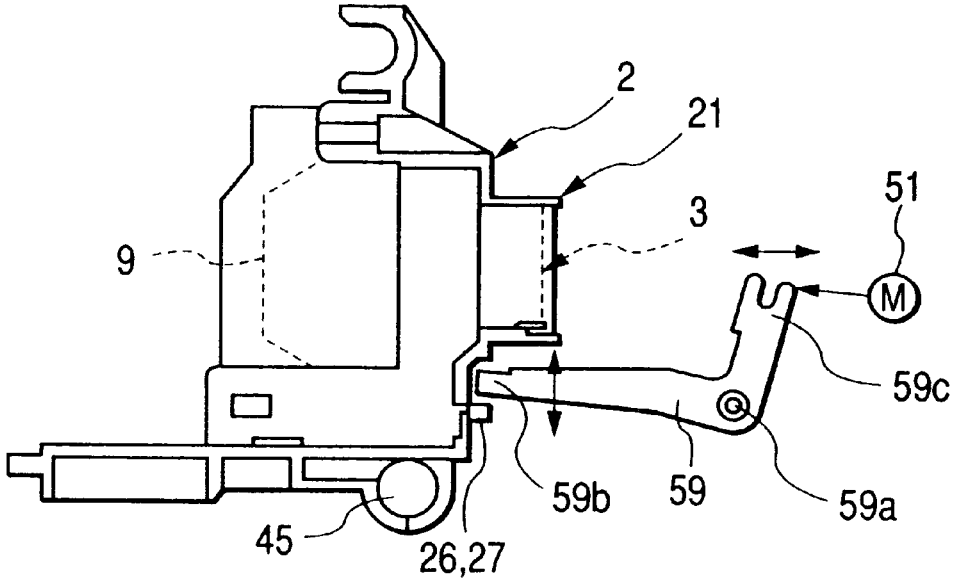
FIG. 3A is a view of the apparatus in FIG. 1 in a state where the carriage lock is disengaged.
FIG. 3B is a view of the apparatus in FIG. 1 in the locked condition.
Figure 3:
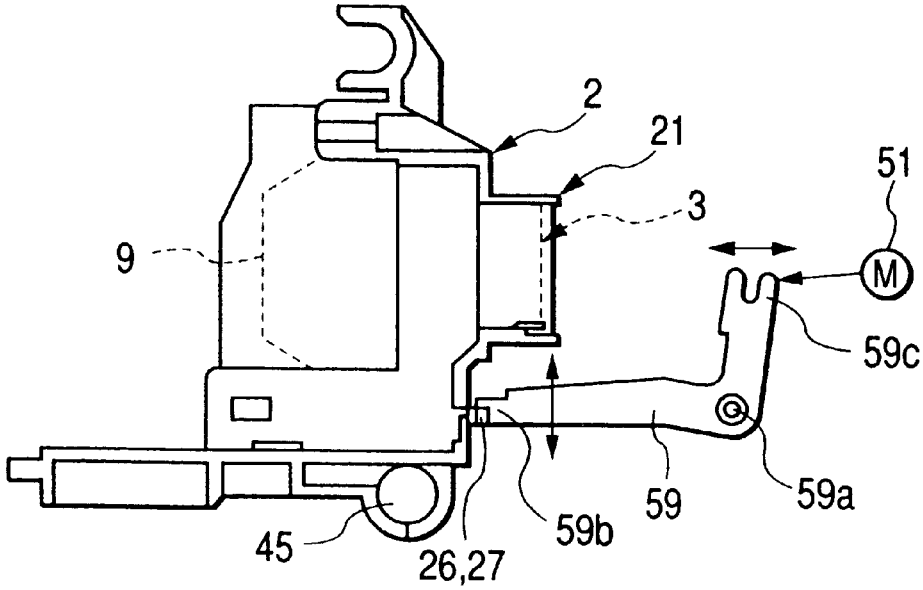

FIG. 1 is a perspective view showing the ink jet recording apparatus of an embodiment according to the present invention, and FIG. 2 is a perspective view showing a part of the apparatus as shown in FIG. 1 as seen from the opposite side. FIG. 3 is a view illustrating the operation of a carriage lock mechanism mounted on the apparatus shown in FIG. 1.

The ink jet recording apparatus 1 has a recording head 3 for ejecting liquid ink drops, and a carriage 2 carrying the recording head 3, a carriage driving mechanism 4 for driving the carriage 2 in a scanning direction as shown by an arrow A, and an ink supply mechanism 10 for supplying the recording head 3 with the liquid ink. The recording head 3 is provided with a nozzle forming face 32 which has a plurality of nozzles 31 for ejecting the liquid ink drops. This nozzle forming face 32 is exposed out of the rectangular opening 30 formed in the carriage 2.

The carriage driving mechanism 4 includes a guide shaft 45, a timing belt 41 stretched between a driving pulley 43 and a following pulley 44, and a carriage motor 42 for rotatably driving the driving pulley 43, as shown in FIG. 2. The lower face of the carriage 2 is slidably supported with respect to the guide shaft 45 and connected to the timing belt 41. When the timing belt 41 is driven by the carriage motor 42, the carriage 2 moves in the scanning direction A along the guide shaft 45.

While driving the carriage 2 in the scanning direction A, the ink supplied from the ink supply mechanism 10 is ejected in a form of liquid ink drops from the nozzles 31 of the recording head 3. A sheet of recording paper 14 is conveyed to the position confronting the nozzle forming face 32 (recording area B), and the ejected liquid ink drops print on a surface of the recording paper 14. A paper feeding roller 17 for feeding a single sheet such as a roll paper 14A, a check 14B or a bill 14C to a common recording area B and a recording paper delivery mechanism 15 including a motor 16 (shown in FIG. 4) for driving the paper feeding roller 17 are provided respectively.

The ink supply mechanism 10 consists of an ink cartridge 7 detachably mounted on an ink cartridge mounting portion 13 formed on an apparatus body 12 of the ink jet recording apparatus 1, a pressure reducing unit 9 mounted on the carriage 2, and an ink supply tube 81 connected between the ink cartridge 7 and the pressure reducing unit (attenuator) 9.

The ink cartridge 7 is formed with a flexible ink bag 72 contained in a rigid case 71. An ink-supply needle 82 fitted to one end portion of the ink supply tube 81 is connected to an ink takeout port 73 formed on the ink bag 72. The other end portion 83 of the ink supply tube 81 is connected to the pressure attenuator 9. The leading end portion of an ink outlet path formed in the pressure attenuator 9 is connected to the recording head 3.

Consequently, the ink stored in the ink bag 72 of the ink cartridge 7 is supplied via the ink supply tube 81 to the pressure attenuator 9 before being sent to the recording head 3. Then the ink supplied to the recording head 3 is ejected from the ink nozzle 31.

A home position of the carriage 2 is provided at a position adjacent to the recording area B as shown by an arrow HP. A head maintenance unit 5 is arranged at a position confronting the home position HP. This head maintenance unit 5 is provided with an ink suction mechanism 55 and the carriage lock mechanism 58.

The ink suction mechanism 55 is provided with a cap 56 which covers the nozzle forming face 32 of the recording head 3 when the recording head 3 has moved to the home position HP. The cap 56 is at a retreated position at a side of a unit case 50 while the carriage 2 is moving in the recording area B.

Pressure is reduced inside the cap 56 by a pump 57 which is actuated by a motor 51 attached to the unit case 50. When the nozzle forming face 32 is covered with the cap 56, a head restoring process, such as sucking the ink as well as residual foam through the ink nozzles 31 and disposing them to the exterior, will be performed by operating the pump 57.

The carriage lock mechanism 58 is provided with a lock arm 59. A forward end 59*b* of the lock arm 59 projects forward from the unit case 50. A bent portion of the lock arm 59 is rotatably supported at the unit case 50 by a swinging center pin 59*a*. A rearward end 59*c* of the lock arm 59 is connected to the motor 51 by a link mechanism and a gear train (not shown) arranged in the unit case 50.

In the maintenance unit 5 of this embodiment, the carriage lock mechanism 58 and the ink suction mechanism 55 are driven by a common motor 51, whose rotation direction and rotation displacement control each action of the mechanisms. As shown in FIGS. 3A and 3B, when the rearward end 59*c* of the lock arm 59 moves backward and forward by the motor 51, the lock arm 59 swings around the swinging center pin 59*a*, and the forward end 59*b* moves up and down in association with the swinging movement.

The carriage 2 is provided with a pair of engaging projections 26 and 27 at a determined space 21 in a direction of movement of the carriage. Moving paths of the engaging projections 26 and 27 in association with the movement of the carriage 2 and a swinging path of the forward end 59*b* of the lock arm 59 are set so that both the paths cross with each other. For example, while the carriage 2 is moving in the recording area B to effect the printing, the forward end 59*b* of the lock arm 59 is retreated to an upper position where it does not cross the moving paths of the projections 26 and 27, as shown in FIG. 3A. In contrast, when the carriage 2 has returned to the home position HP after the printing is finished, the forward end 59*b* of the lock arm 59 swings downward placing the forward end 59*b* of the lock arm 59 in the space 21 formed between the projections 26 and 27 as shown in FIG. 3B. As a result, the carriage 2 engages with the lock arm 59, through projections 26 and 27, into a locked condition at the home position HP. To disengage the carriage lock from this locked condition, the forward end 59*b* of the lock arm 59 may be swung again to the upper retreated position.

Figure 4:
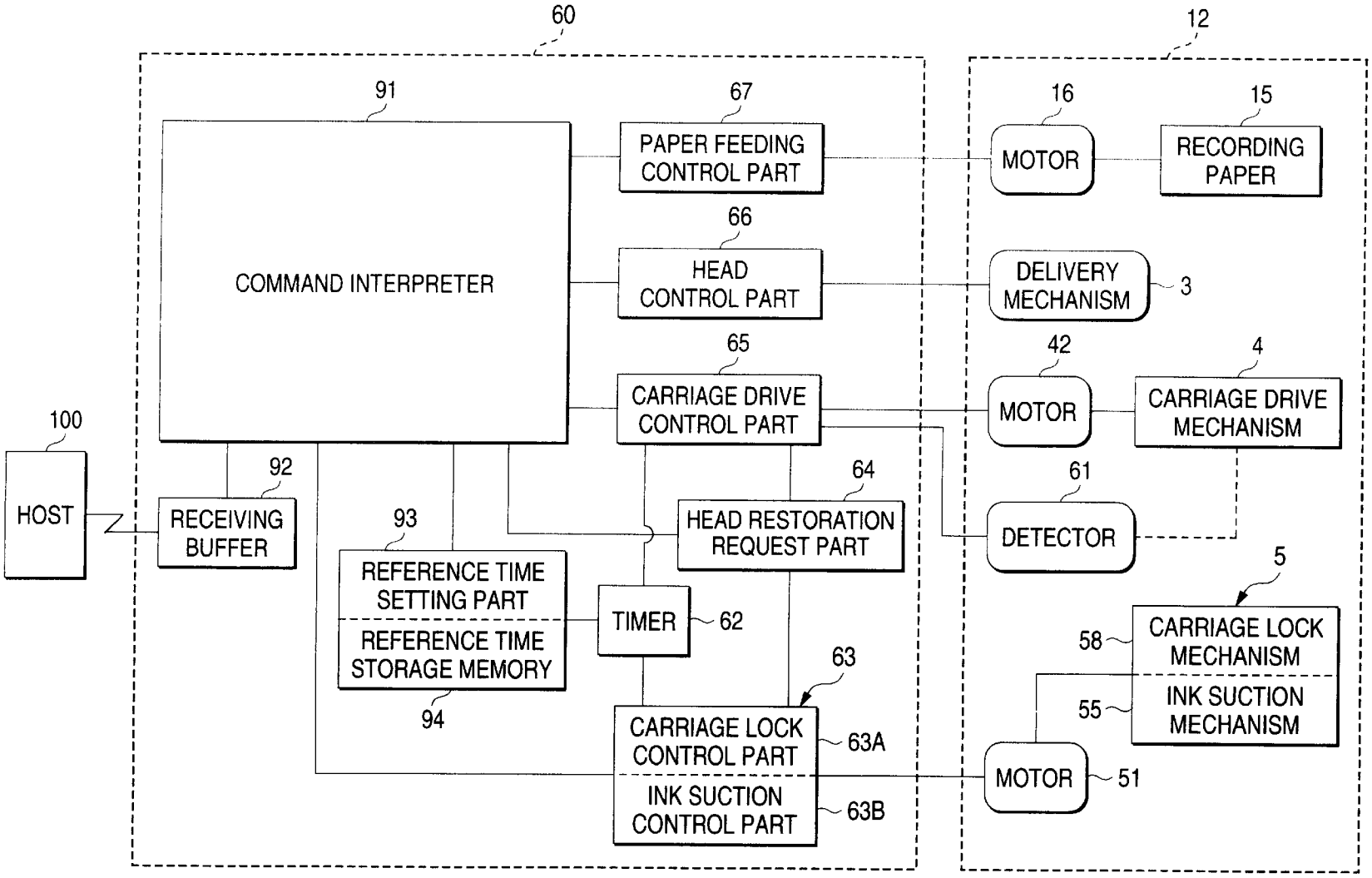
FIG. 4 is a functional block diagram showing the ink jet recording apparatus to which the invention is applied

Referring to FIGS. 2 and 4, a drive control system 60 comprises a receiving buffer 92 for receiving a command and data transmitted from a host 100 and a command interpreter 91 for analyzing the received command. Moreover, the drive control system 60 comprises a paper feeding control part 67 for controlling the drive of the recording paper delivery mechanism 15 (motor 16), a head control part 66 for controlling the drive of the recording head 3, a carriage controller 65 for controlling the drive of the carriage driving mechanism 4 (motor 42), and a maintenance unit drive controller 63 for controlling the drive of the maintenance unit 5 (motor 51). The recording head 3 and the mechanisms 4, 5 and 15 are controlled by the control parts. 63, 65, 66 and 67 based on the command analyzed by the command interpreter 91.

Furthermore, the drive control system.60 comprises a timer 62 for measuring the waiting time while the carriage 2 is at the home position HP, a reference time storage memory 94 for storing a reference time taken for the reference of the timer 62 when measuring the waiting time, and a reference time set part 93 for setting the reference time to the reference time storage memory 94 or changing the reference time stored in the reference time storage memory 94 based on the command analyzed by the command interpreter 91.

The unit drive controller 63 is divided into a carriage lock mechanism control part 63A for controlling the drive of the carriage lock mechanism 58, and an ink suction mechanism control part 63B for controlling operation of the ink suction mechanism 55.

In the case in which the command transmitted from the host is a printing command as a result of the analysis of the command interpreter 91, the carriage controller 65 actuates the motor 42 and reciprocates the carriage 2 in the recording area B according to the printing command. The head control part 66 drives the recording head 3 synchronously with the reciprocation of the carriage 2. Moreover, the paper feeding control part 67 properly drives the motor 16 and delivers the recording paper 14 according to the printing command. After the printing process is finished, the carriage control part 65 moves the carriage 2 to the home position HP.

When a head restoration request is issued from a head restoration requester 64, the carriage controller 65 interrupts printing (which can occur even during the printing process), and moves the carriage 2 to the home position HP. In this case, the controller 65 need not necessarily respond to the head restoration request instantly, but can wait, for example, until printing is finished, to move the carriage 2 to the home position HP.

The head restoration requester 64 may be a manual switch which is provided, for example, on a case of the ink jet recording apparatus 1 for instructing the head restoring process, or other means for receiving commands (head restoration commands) from the host computer to request the head restoring process. Moreover, the head restoring process may be automatically executed on the basis of lapse of time and amount of printing since the previous head restoring process.

The carriage controller 65 receives a signal from a detector 61 for detecting that the carriage 2 has returned to the home position HP. The detector 61 may be, but is not limited to, a micro switch. Once the detector 61 has determined that the carriage 2 has returned to the home position HP, the waiting time during which the carriage stays at the home position HP is measured by the timer 62. The detector 61 is also used for establishing the position of the carriage 2, when electric power is applied to initialize the mechanism part.

If a step motor is used for the motor 42 to conduct an open loop control, detection by the detector 61 does not necessarily have to be a trigger to start the measurement by the timer 62. However, in order to ensure the lock of the carriage 2 at the home position, use of the detector 61 is preferable.

If the waiting time of the carriage measured by the timer 62 has reached or exceeded the reference time set to the reference time storage memory 94 in the carriage lock driving control part 63A of the driving control system 60, that is, a constant time passes without the printing command, the carriage lock drive control part 63A of the drive control system 60 actuates the carriage lock mechanism 58 to bring the carriage 2 into the locked condition.

If the time (reference time) taken while the carriage 2 is moved to the home position and the carriage lock is then carried out is too short, the frequency of carriage lock actuation is not reduced and durability is not enhanced. On the other hand, if the reference time is too long, the period in which the carriage is not locked becomes long which will increase risks of ink leakage due to vibrations, shocks, etc. For this reason, it is preferable to set the reference time at an appropriate value according to the way of using the relevant printer as will be illustrated below.

In the case of a POS printer installed in a store, the reference time can be set to be longer (for example, 20 to 50 seconds). In the case of the POS printer, it is rarely supposed that a power supply is turned off unexpectedly. Therefore, even if the reference time is thus set to be longer, there is rarely caused such a drawback that the power supply is turned off in the state in which the carriage lock is not actuated. In particular, it is effective that the reference time is set to be longer in a store that a large number of customers visit. Moreover, during a time zone in which the store is crowded, the reference time may be changed to be longer. In the case of a mobile store, oscillations or shocks might be applied to the POS printer. Therefore, it is preferable that the reference time should be set to be shorter (for example, approximately 5 to 10 seconds).

In the case of a printer for personal use, it is preferable that the reference time should be set to be slightly shorter (for example, approximately 5 to 10 seconds). It is sufficiently supposed that some users might turn off a power supply unexpectedly after the printing process. Therefore, if the reference time is set to be long, the printer might be left or moved without carriage locking actuated. In the case of a mobile printer, particularly, it is preferable that the reference time should be set to be shorter.

When the head restoration request is issued from the head restoration requester 64, the carriage lock mechanism 58 will be instantly actuated, regardless of the waiting time which puts the carriage 2 in the locked condition. When the carriage is positioned in the printing area B as described above, the carriage controller 65 moves the carriage 2 to the home position at the head restoration request, and then, the carriage lock control part 63A rapidly actuates the carriage lock mechanism 58 to put the carriage 2 in the locked condition. After the carriage 2 has been locked, the ink suction control part 63B actuates the ink suction mechanism 55 to suck the ink through the nozzles 31 of the recording head 3.

The above described parts 62, 63 to 67 and 91 to 94 are composed of ROM or the like which stores programs for regulating a microprocessor (CPU) as well as its operations and RAM for storing printing data received from the host and other data to be stored temporarily. The above described functions can be realized by driving and controlling the motors 42, 51 and 16 and the recording head 3 according to the programs, carrying out a communication process together with the host 100 and analyzing the received commands.

Figure 5:
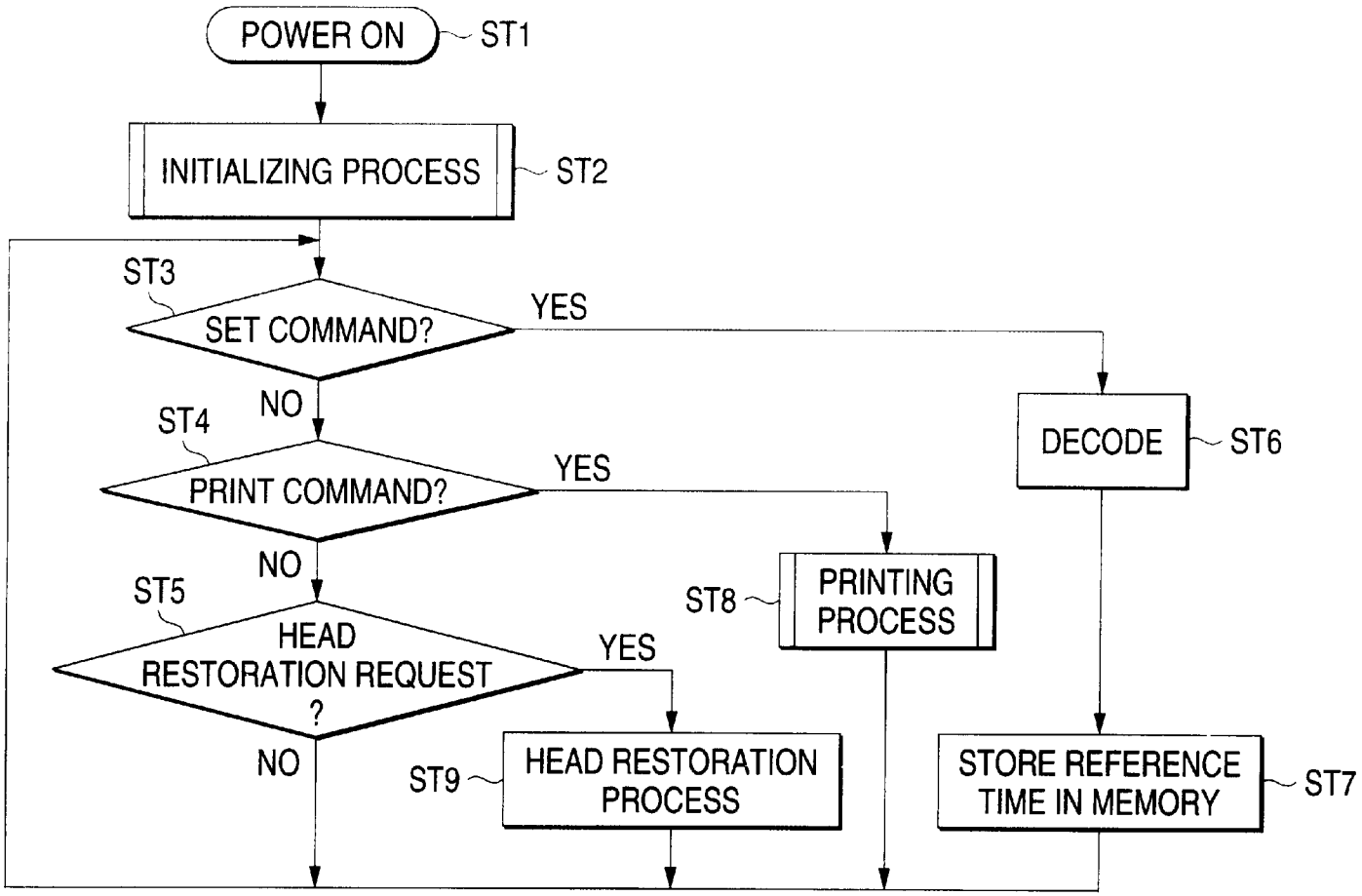
FIG. 5 is a flow chart illustrating the control operations of the apparatus as shown in FIG. 1.
Figure 6:
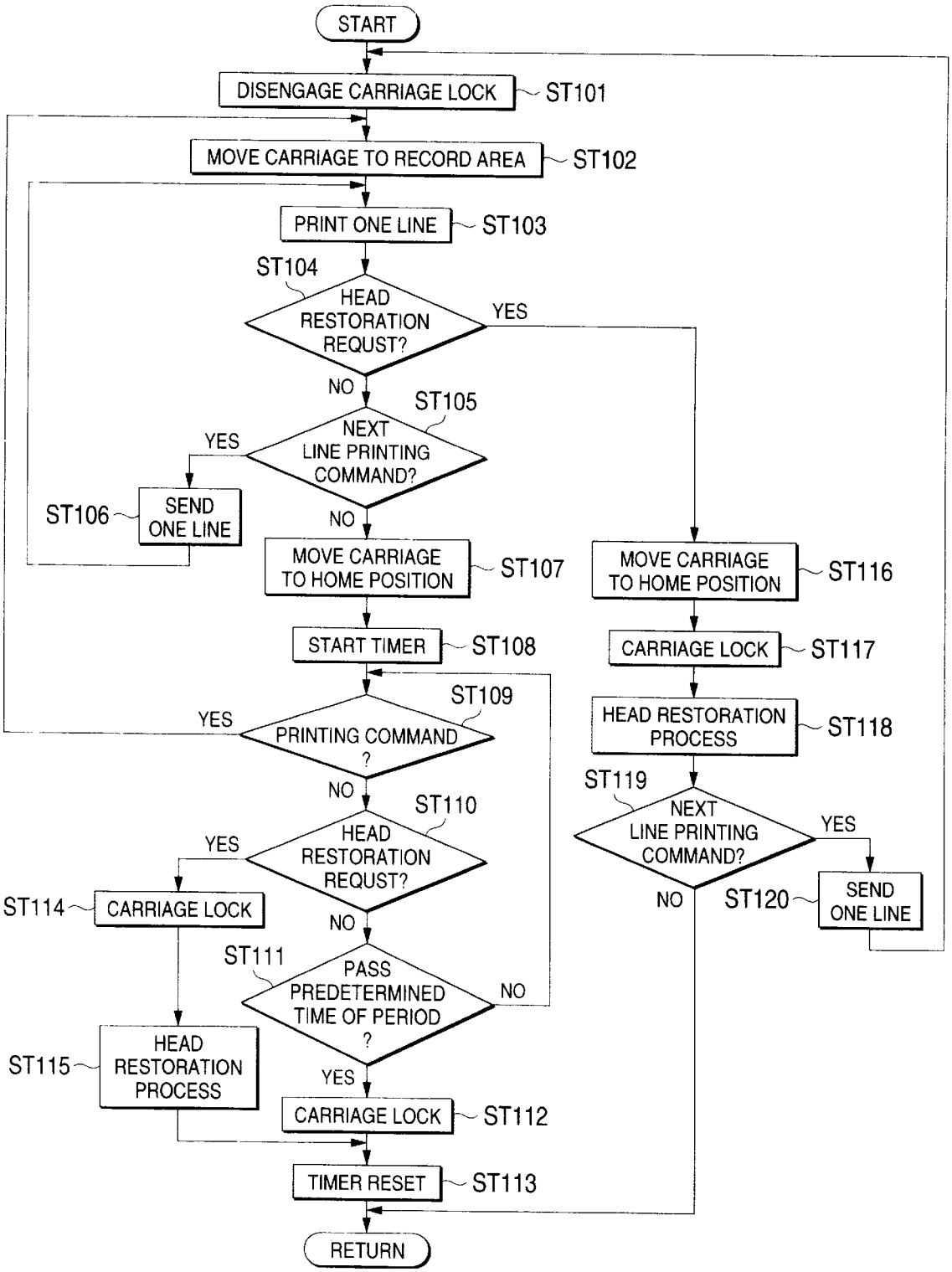
FIG. 6 is a flow chart illustrating the details of the steps for a printing process of the flow chart in FIG. 5.
Figure 7:
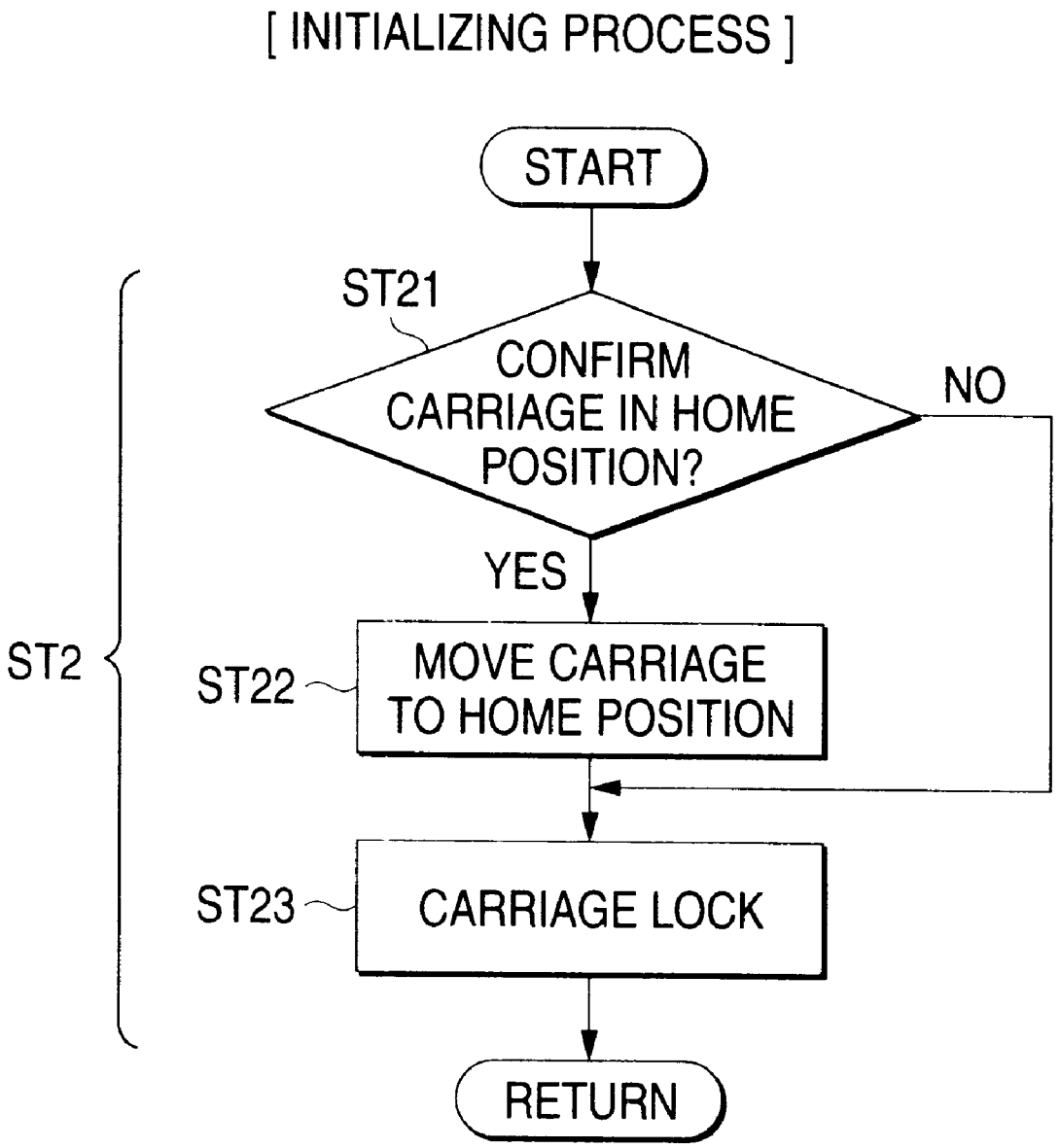
FIG. 7 is a flow chart illustrating the details of the steps for an initializing process of the flow chart in FIG. 5.

FIGS. 5 to 7 are flow charts showing the operation of the ink jet recording apparatus 1 of this embodiment, referring mainly to the carriage lock operation by the carriage lock mechanism. The operation of the carriage lock mechanism will be explained according to these flow charts.

Electric power is supplied in step ST1, and the initializing process begins in step ST2. During the initializing process, it is confirmed in step ST21, as shown in FIG. 7, that the carriage 2 is at the home position HP. If the carriage is at the home position HP, then in step ST 23 the carriage lock is performed. If the carriage 2 is not at the home position HP, then the carriage 2 is moved to the home position HP at step ST22 and the carriage lock is performed in step ST23.

Then, the ink jet recording apparatus 1 is brought into a command waiting condition (steps ST3 to ST5). More specifically, a command is received from the host 100 and is analyzed by the command interpreter 91. As a result, if the received command is a set command for setting or changing the time (reference time) while the carriage 2 is moved to the home position and the carriage lock is then carried out (step ST3), the contents are decoded (step ST6) and are stored in the reference time storage memory 94.

On the other hand, if the received command is a printing command (step ST4), a printing process which will be described below (step ST8) is carried out. Moreover, if the head restoration request is generated during the command waiting condition (step ST9), the ink sucking process, that is, the head restoration process is carried out through the ink suction mechanism 55 (step ST9).

The printing process (step ST8) is carried out in the procedure shown in FIG. 6. The carriage lock is disengaged in step ST 101, and the carriage 2 is moved to the recording area B in step ST 102. In steps ST 103 and ST 104, each time a line has been printed, it is determined whether or not there is a head restoration request. Where no head restoration request has been received, it is determined whether or not there are printing data for the next line in step ST 105. If there are printing data, paper is fed for one line through the recording paper delivery mechanism 15 and the next line is printed in steps ST 106 and ST 103, respectively.

When printing is detected as finished in step ST 105, the carriage 2 is returned to the home position HP in step ST 107. In step ST 108, counting of the waiting time since the carriage 2 has returned to the home position HP starts. The carriage remains in the home position HP until the reference time set to the reference time storage memory 94 has expired, and the carriage 2 waits for a new printing command in step ST 109, and furthermore, a head restoration request in step ST110.

When the waiting time of the carriage 2 at the home position HP has exceeded the reference time, that is, the count value of the timer 62 has reached or exceeded the reference time, proceeding to step ST 112, the carriage lock is engaged. Then the timer is reset at step ST 113 and the process begins again in step ST3 in FIG. 5, waiting for a command again.

Where the new command is received before expiration of the reference time, the carriage lock will not be actuated. In this case, immediately returning to step ST 102 from step ST 109, the carriage 2 is moved to perform printing based on the new printing command.

Moreover, in the case in which the head restoration request is issued before the waiting time passes the reference time, the process proceeds from step ST110 to step ST114 where the carriage lock is immediately actuated, and then, the same head restoration process as that of step ST9 shown in FIG. 5 is carried out in step ST115. Subsequently, the timer is reset in step ST113 and the process is returned to step ST3 shown in FIG. 5, waiting for a command again.

Where one line is printed in step ST104 and the head restoration request is then issued, shifting from step ST 104 to step ST 116, the carriage 2 is moved to the home position HP, and the carriage lock is immediately engaged in step ST 117. In step ST 118, the ink suction mechanism 55 suctions ink, that is, the head restoring process will be conducted.

If the head restoring process is conducted before all the lines have been printed, proceeding from step ST 119 to step ST 120, after paper is fed for one line, the carriage lock will be disengaged in step ST101 again, the carriage is moved to the recording area in step ST102 and the printing process is then restarted after step ST 103. If there is no printing data for the next line at step ST 119, then the command is awaited again in step ST3 of FIG. 5 with the carriage lock maintained.

Situations in which head restoration requests are issued include but are not limited to the following reasons: the waiting time since the previous ink suction process has exceeded the preset time; a head restoration command is transmitted from the host; and a manual operating member is switched on where the ink suction action can be actuated by manual operation.

In this embodiment, the lever is driven by the motor. The invention is not limited by this embodiment. It is capable of employing any ink jet recording apparatus comprising a carriage lock mechanism. For example, the solenoid (electromagnet)is used as a driving source, and the lock condition is maintained when the power is cut off.

In this embodiment, moreover, description has been given to the example in which the time (reference time) taken while the carriage 2 is moved to the home position and the carriage lock is then actuated is set or changed according to the command transmitted from the host, which is not restricted. For example, a plurality of reference times may be prestored in the reference time storage memory, and one of the reference times may be selected according to the command transmitted from the host. Furthermore, the reference time setting part may be constituted by a switch such as a dip switch, and one of the reference times prestored in the reference time storage memory may be selected.

A number of embodiments of the present invention have been described. Nevertheless, it will be understood that various modifications may be made without departing from the spirit and scope of the invention. Accordingly, other embodiments are within the scope of the following claims.

What is claimed is:

1. An ink jet recording apparatus comprising:

a recording head for ejecting ink liquid drops;

a carriage for carrying said recording head and adapted to translate between a recording area and a home position;

a carriage lock mechanism for locking said carriage at said home position;

a carriage controller for translating said carriage to said home position;

a timer for measuring a waiting time during which said carriage is at said home position;

a lock controller which allows said carriage lock mechanism and said carriage to be into a locked condition when said waiting time measured by said timer has reached or exceeded a reference time; and setting means for setting or changing said reference time.

2. An ink jet recording apparatus as claimed in claim 1, further comprising a memory for storing said reference time and a command interpreter for receiving and analyzing a command transmitted from a host device, wherein said setting means stores a value of said reference time in said memory or changes a value stored in said memory based on a set command for setting or changing the value of said reference time if a command analyzed in said command interpreter is said set command.

3. An ink jet recording apparatus as claimed in claim 2, wherein if said command analyzed in said command interpreter is a printing command, said carriage controller is adapted to translate said carriage from said home position to said recording area according to said printing command, and to translate said carriage to said home position after a printing process.

4. An ink jet recording apparatus as claimed in claim 2, further comprising an ink suction mechanism for sucking ink through nozzles in said recording head and discharging said ink to the exterior to restore said recording head, wherein when said command analyzed in said command interpreter is a head restoration command for carrying out a restoration process of said head through said ink suction mechanism, said lock controller drives said carriage lock mechanism so as to switch said carriage into a locked condition regardless of said waiting time.

5. An ink jet recording apparatus as claimed in claim 1, further comprising:

an ink suction mechanism for sucking ink through nozzles in said recording head and discharging said ink to the exterior to restore said recording head; and a head restoration requester for requesting a head restoration by said ink suction mechanism, wherein said lock controller drives said carriage lock mechanism so as to lock said carriage at said home position regardless of said waiting time when receiving said head restoration.

6. An ink jet recording apparatus of claim 1, wherein said lock controller drives said carriage lock mechanism regardless of the waiting time, immediately after a driving power has been applied, to lock said carriage at said home position.

7. An ink jet recording apparatus of claim 1, further comprising a detector for detecting that said carriage has been translated to the home position, said timer measuring the waiting time on the basis of results of detection by said detector.

8. An ink jet recording apparatus as claimed in claim 1, wherein said setting means is constituted by a dip switch for selecting one of a plurality of values prepared in advance and for setting said value to be said reference time.

9. A method for controlling an ink jet recording apparatus comprising a recording head for ejecting liquid ink drops, a carriage carrying said recording head and adapted to translate between a recording area and a home position, and a carriage lock mechanism for locking said carriage at said home position, the method comprising the steps of:

(a) translating a carriage from a home position to a recording area according to a printing command;

(b) translating said carriage to said home position after printing is finished;

(c) measuring a waiting time during which said carriage stays at said home position after said step (b);

(d) driving said carriage lock mechanism when said waiting time has reached a reference time, to lock said carriage at said home position; and (e) setting or changing said reference time.

10. The method of claim 9 further comprising a step of (f) interrupting measurement of said waiting time, on receiving the printing command again within said reference time, in the previous step (d), and translating said carriage from said home position to said recording area.

11. The method of claim 9, wherein said ink jet recording apparatus comprises an ink suction mechanism for restoring said recording head by sucking ink through ink nozzles of said recording head and discharging said ink to the exterior to restore said recording head, said method further comprising a step of (g) driving said carriage lock mechanism regardless of said waiting time to lock said carriage at said home position, when receiving a head restoration command.

12. A method for controlling an ink jet recording apparatus comprising a recording head for ejecting ink liquid drops, a carriage for carrying said recording head and adapted to translate between a recording area and a home position, and a carriage lock mechanism for locking said carriage at said home position, comprising the steps of:

(a) receiving and analyzing a command transmitted from a host device;

(b) moving said carriage from said home position to said recording area according to said received command when said received command is a printing command;

(c) moving said carriage to said home position after a printing process;

(d) measuring a waiting time for which said carriage is at said home position after executing said step (c);

(e) driving said carriage lock mechanism to switch said carriage into a locked condition when said waiting time reaches or exceeds a reference time; and (f) setting or changing said reference time if said received command is a set command for setting or changing a value of said reference time.

13. The method for controlling an ink jet recording apparatus as claimed in claim 12, further comprising a step of (g) receiving and analyzing a command transmitted from said host device again before said waiting time reaches said reference time, stopping said measurement of said waiting time when said command is a printing command, and moving said carriage from said home position to said recording area.

14. The method for controlling an ink jet recording apparatus as claimed in claim 12, wherein said ink jet recording apparatus comprises an ink suction mechanism for sucking ink through ink nozzles in said recording head and discharging said ink to the exterior to restore said recording head, further comprising a step of (h) driving said carriage lock mechanism to switch said carriage into a locked condition regardless of said waiting time if said received command is a head restoration command for carrying out a head restoration process through said ink suction mechanism.

15. An ink jet recording apparatus comprising:

a recording head for ejecting ink liquid drops;

a carriage that carries said recording head, the carriage being configured to translate between a recording area and a home position;

a carriage lock mechanism coupled with the carriage, the carriage lock mechanism selectively locking said carriage at said home position;

a carriage controller operatively coupled with said carriage, said carriage controller translating said carriage to said home position according to operating parameters of the recording apparatus;

a timer that measures a waiting time during which said carriage is at said home position;

a lock controller communicating with said timer, said lock controller actuating said carriage lock mechanism when said waiting time measured by said timer has reached or exceeded a reference time; and a setting interface communicating with said lock controller, said setting interface enabling setting or changing of said reference time.

* * * * *